US009879951B2

(12) United States Patent
Biggs et al.

(10) Patent No.: US 9,879,951 B2
(45) Date of Patent: Jan. 30, 2018

(54) SHOCK HARDENED INITIATOR AND INITIATOR ASSEMBLY

(71) Applicant: Raytheon Company, Waltham, MA (US)

(72) Inventors: Bradley Biggs, Corona, AZ (US); Timothy B. Bonbrake, Tucson, AZ (US); George Darryl Budy, Tucson, AZ (US); Christopher Schott, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 14/625,144

(22) Filed: Feb. 18, 2015

(65) Prior Publication Data

US 2016/0178333 A1 Jun. 23, 2016

Related U.S. Application Data

(63) Continuation-in-part of application No. 14/257,181, filed on Apr. 21, 2014, which is a continuation of (Continued)

(51) Int. Cl.
*F42B 3/12* (2006.01)
*F42C 9/00* (2006.01)
(Continued)

(52) U.S. Cl.
CPC ..... *F42B 3/124* (2013.01); *F42B 3/125* (2013.01); *F42C 9/00* (2013.01); *F42C 14/00* (2013.01); *F42C 19/02* (2013.01)

(58) Field of Classification Search
CPC .. F42B 3/12; F42B 3/124; F42B 3/121; F42B 3/128; F42B 3/13; F42C 19/00; F42C 19/02; F42C 14/00
(Continued)

(56) References Cited

U.S. PATENT DOCUMENTS 2,399,034 A 4/1946 Huyett
3,363,565 A 1/1968 Walther
(Continued)

FOREIGN PATENT DOCUMENTS

WO WO-2005025937 A2 3/2005
WO WO-2012108931 A1 8/2012
WO WO-2016134028 A1 8/2016

OTHER PUBLICATIONS

US 9,488,451, 11/2016, Biggs et al. (withdrawn)
(Continued)

*Primary Examiner* — Benjamin P Lee
(74) *Attorney, Agent, or Firm* — Schwegman Lundberg & Woessner, P.A.

(57) ABSTRACT

An initiator assembly includes an initiator housing having an initiator cavity and a housing orifice edge. A bridge substrate is positioned within the initiator cavity, the bridge substrate includes a substrate base including a uniform first planar surface and first and second bridge contacts flush with the uniform first planar surface. The first and second bridge contacts form a continuous planar mounting surface. An explosive charge and a flyer plate are within the initiator cavity, the flyer plate interposed between the explosive charge and the bridge substrate. A plunger head is telescopically received in the initiator cavity and includes an anchoring cylinder face having a face perimeter and extends between first and second face ends. The housing orifice edge is anchored to the anchoring cylinder face at a position between the first and second face ends and extends around the face perimeter.

24 Claims, 6 Drawing Sheets

Related U.S. Application Data application No. 13/022,164, filed on Feb. 7, 2011, now Pat. No. 8,701,557.

(51) Int. Cl.
*F42C 14/00* (2006.01)
*F42C 19/02* (2006.01)

(58) Field of Classification Search
USPC ..... 102/200, 202.5, 202.8, 202.9, 202.12, 102/202.14, 206
See application file for complete search history.

(56) References Cited

U.S. PATENT DOCUMENTS

| | | | | |
|---|---|---|---|---|
| 3,763,782 | A | 10/1973 | Bendler | |
| 5,088,413 | A | 2/1992 | Huber et al. | |
| 5,454,320 | A * | 10/1995 | Hilden | F42B 3/103 102/202.14 |
| 5,686,691 | A | 11/1997 | Hamilton et al. | |
| 5,969,286 | A | 10/1999 | Ward et al. | |
| 6,158,347 | A | 12/2000 | Neyer et al. | |
| 6,502,512 | B2 | 1/2003 | Riviere et al. | |
| 6,672,215 | B2 | 1/2004 | Daoud et al. | |
| 6,907,827 | B2 | 6/2005 | Tirmizi et al. | |
| 7,770,520 | B2 * | 8/2010 | Fink | F42B 3/103 102/202.12 |
| 7,866,264 | B2 | 1/2011 | Nance et al. | |
| 8,408,131 | B1 | 4/2013 | Nance et al. | |
| 8,485,097 | B1 * | 7/2013 | Nance | F42B 3/18 102/200 |
| 8,701,557 | B2 | 4/2014 | Biggs | |
| 2002/0178956 | A1 * | 12/2002 | Mattes | F42B 3/13 102/202.12 |
| 2008/0134921 | A1 * | 6/2008 | Nance | F42B 3/13 102/202.5 |
| 2008/0148982 | A1 | 6/2008 | Hennings et al. | |
| 2009/0223400 | A1 | 9/2009 | Hill | |
| 2009/0266260 | A1 * | 10/2009 | Nance | F42B 3/13 102/202.7 |
| 2011/0072997 | A1 * | 3/2011 | Nance | F42B 3/103 102/202.7 |
| 2012/0199030 | A1 | 8/2012 | Biggs et al. | |
| 2014/0224142 | A1 | 8/2014 | Biggs et al. | |

OTHER PUBLICATIONS

"U.S. Appl. No. 13/022,164, Non Final Office Action dated May 21, 2013", 14 pgs.
"U.S. Appl. No. 13/022,164, Notice of Allowance dated Dec. 6, 2013", 10 pgs.
"U.S. Appl. No. 13/022,164, Response filed Aug. 30, 2013 to Non Final Office Action dated May 21, 2013", 18 pgs.
"International Application Serial No. PCT/US/2011/064906, International Search Report dated Apr. 19, 2012", 2 pgs.
"International Application Serial No. PCT/US2011/064906, International Preliminary Report on Patentability dated Aug. 22, 2013", 8 pgs.
"International Application Serial No. PCT/US2011/064906, Written Opinion dated Apr. 19, 2012", 6 pgs.
"U.S. Appl. No. 14/257,181, Advisory Action datws Mar. 1, 2016", 3 pgs.
"U.S. Appl. No. 14/257,181, Examiner Interview Summary dated May 26, 2016", 2 pgs.
"U.S. Appl. No. 14/257,181, Final Office Action dated Dec. 10, 2015", 18 pgs.
"U.S. Appl. No. 14/257,181, Non Final Office Action dated May 4, 2015", 15 pgs.
"U.S. Appl. No. 14/257,181, Response filed Aug. 31, 2015 to Non Final Office Action dated May 4, 2015", 11 pgs.
"U.S. Appl. No. 14/257,181, Response filed Apr. 7, 2016 to Advisory Action dated Mar. 1, 2016", 18 pgs.
"U.S. Appl. No. 14/257,181, Response filed Feb. 5, 2016 to Final Office Action dated Dec. 10, 2015", 18 pgs.
"U.S. Appl. No. 14/257,181, Comments on Reasons for Notice of Allowance filed Aug. 16, 2016", 1 pg.
"U.S. Appl. No. 14/257,181, Notice of Allowance dated Jun. 17, 2016", 11 pgs.
"U.S. Appl. No. 14/257,181, Response filed Jun. 10, 2016 to Examiner Interview Summary dated May 26, 2016", 2 pgs.
"International Application Serial No. PCT/US2016/018285, International Search Report dated Jun. 1, 2016", 5 pgs.
"International Application Serial No. PCT/US2016/018285, Written Opinion dated Jun. 1, 2016", 10 pgs.

* cited by examiner

SHOCK HARDENED INITIATOR AND INITIATOR ASSEMBLY

CLAIM OF PRIORITY

This patent application claims the benefit of priority, under 35 U.S.C. Section 120, to Biggs et al., U.S. Pat. No. 8,701,557, entitled "SHOCK HARDENED INITIATOR AND INITIATOR ASSEMBLY," filed on Feb. 7, 2011, which is hereby incorporated by reference herein in its entirety.

This patent application claims the benefit of priority, under 35 U.S.C. Section 120, to Biggs et al., U.S. patent application Ser. No. 14/257,181, entitled "SHOCK HARDENED INITIATOR AND INITIATOR ASSEMBLY," filed on Apr. 21, 2014, which is hereby incorporated by reference herein in its entirety.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever. The following notice applies to the software and data as described below and in the drawings that form a part of this document: Copyright Raytheon Company, Waltham Mass. All Rights Reserved.

TECHNICAL FIELD

Embodiments pertain to explosive initiation. Some embodiments relate to initiators and initiator assemblies.

BACKGROUND

Explosive payloads are delivered in a variety of vehicles including missiles, gun fired projectiles, bombs and the like. Targets are located within hardened structures having impact and explosive resistant walls or structure (e.g., overlying rock and the like). Successful delivery of the payload to the target often requires penetration of the payload through the protective structure followed by detonation within or near the target.

Impact and penetration of the delivery vehicle and explosive payload transmits significant shock loads to the sensitive materials within the vehicle and causes one or more of acceleration, deceleration, rebounding of materials, movement of the material relative to other sensitive components and the like. One sensitive feature within the delivery vehicle is the initiator used to detonate the explosive payload. The shock loading and rapid deceleration of the delivery vehicle transmits stress to the explosive charge within the initiator. The stress may cause the explosive charge to crack and correspondingly prevent proper initiation of the charge resulting in failure of the explosive payload to detonate.

SUMMARY

In accordance with some embodiments, an initiator assembly and method for supporting an explosive charge is discussed that supports the initiator components during delivery, impact and penetration and ensures reliable initiation and corresponding detonation of the explosive payload.

Other features and advantages will become apparent from the following description of the preferred example, which description should be taken in conjunction with the accompanying drawings.

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

A more complete understanding of the present subject matter may be derived by referring to the detailed description and claims when considered in connection with the following illustrative Figures. In the following Figures, like reference numbers refer to similar elements and steps throughout the Figures.

Elements and steps in the Figures are illustrated for simplicity and clarity and have not necessarily been rendered according to any particular sequence. For example, steps that may be performed concurrently or in different order are illustrated in the Figures to help to improve understanding of examples of the present subject matter.

DETAILED DESCRIPTION

In the following detailed description, reference is made to the accompanying drawings which form a part hereof, and in which is shown by way of illustration specific examples in which the subject matter may be practiced. These examples are described in sufficient detail to enable those skilled in the art to practice the subject matter, and it is to be understood that other examples may be utilized and that structural changes may be made without departing from the scope of the present subject matter. Therefore, the following detailed description is not to be taken in a limiting sense, and the scope of the present subject matter is defined by the appended claims and their equivalents.

The present subject matter may be described in terms of functional block components and various processing steps. Such functional blocks may be realized by any number of techniques, technologies, and methods configured to perform the specified functions and achieve the various results. For example, the present subject matter may employ various materials, actuators, electronics, shape, airflow spaces, reinforcing structures, explosives and the like, which may carry out a variety of functions. In addition, the present subject matter may be practiced in conjunction with any number of devices, and the systems described are merely exemplary applications.

Figure 1:
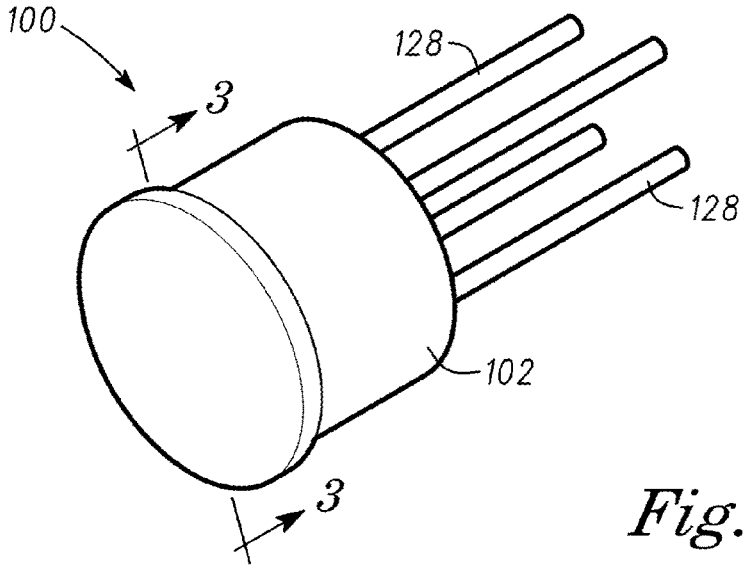
FIG. 1 is a perspective view of one example of an initiator assembly in accordance with some embodiments.

FIG. 1 shows one example of an initiator assembly 100 for use in an explosive payload delivery device, including but not limited to, a gun-fired projectile, missile, bomb and the like. The initiator assembly 100 includes, as shown in FIG. 1, an initiator housing 102 and one or more initiator leads 128 extending from the initiator housing 102. In one example, the initiator leads 128 are coupled with a current source, such as a capacitor. As will be described in further detail below, transmission of current from the capacitor through the initiator leads 128 detonates an explosive charge within the initiator housing 102 configured to initiate and detonate an explosive payload within the explosive delivery device.

Figure 2:
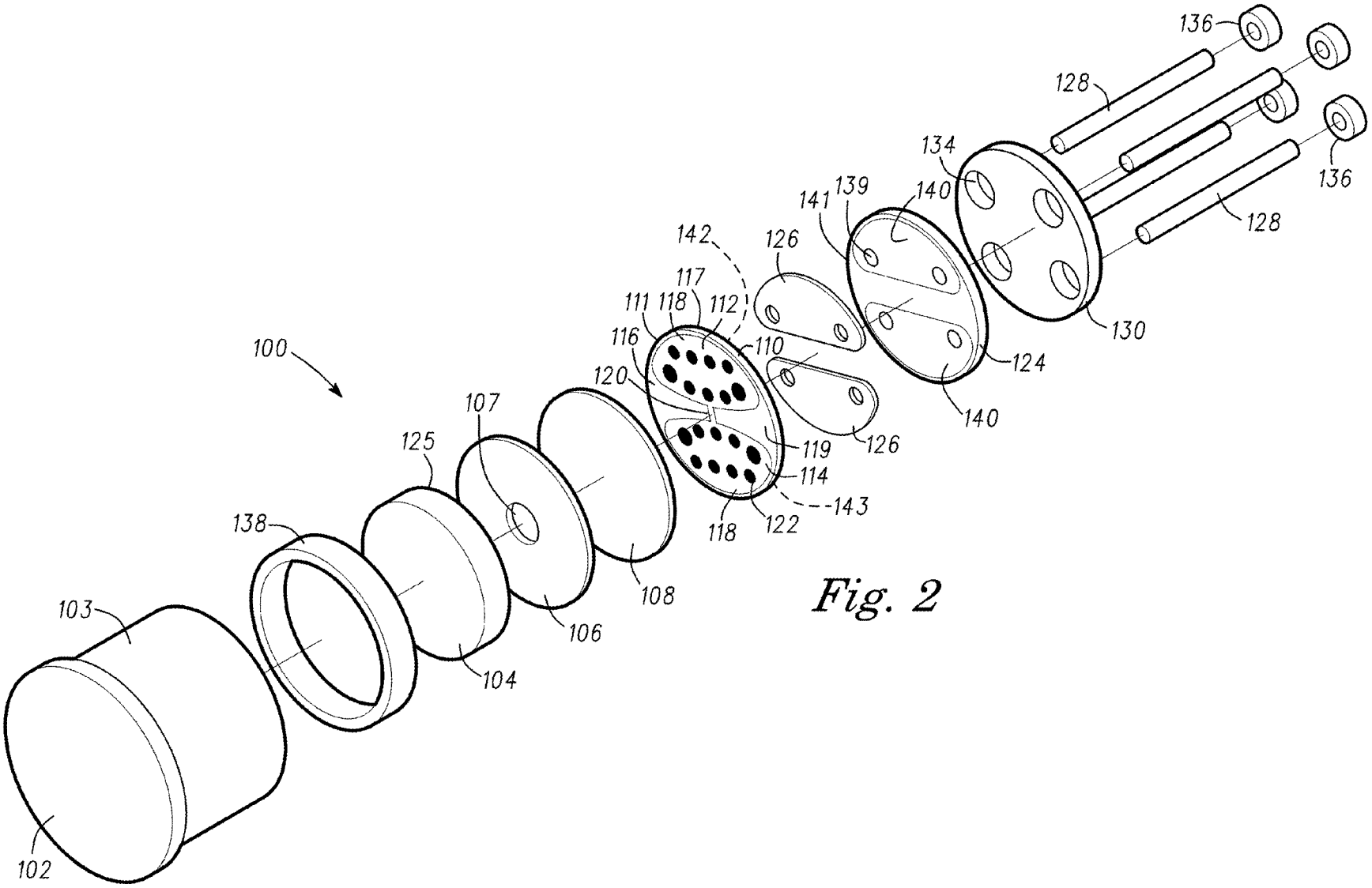
FIG. 2 is an exploded view of the initiator assembly shown in FIG. 1 in accordance with some embodiments.

Referring now to FIG. 2, an exploded view of the initiator assembly 100 is shown. The initiator assembly 100 includes the initiator housing 102 shown previously in FIG. 1 along with a series of components sized and shaped to fit within an initiator cavity 103. Referring again to FIG. 2, the initiator assembly 100 includes an explosive charge 104 sized and shaped for reception within the initiator cavity 103. A barrel 106 is positioned adjacent to the explosive charge 104. The barrel 106 includes a barrel lumen 107. A flyer plate 108 is positioned on the opposed side of the barrel 106 relative to the explosive charge 104. As will be described in further detail below, when the initiator assembly 100 is activated the flyer plate 108 is projected toward the explosive charge 104 and passes, at least in part, through the barrel lumen 107 to initiate a surface to surface impact with the charge mounting surface 125 of the explosive charge 104. Striking of the explosive charge 104 by the flyer plate 108 initiates the explosive charge 104 and correspondingly detonates the explosive payload of the delivery device the initiator assembly 100 is housed within.

Referring again to FIG. 2, the initiator assembly 100 further includes a bridge substrate 110. As shown in FIG. 2, the bridge substrate 110 is sized and shaped to snugly fit within the initiator cavity 103. Stated another way, the bridge substrate 110 includes a surface area substantially corresponding to a corresponding cross sectional surface area covered by the initiator cavity 103 and the explosive charge 104. In the example shown in FIG. 2, the initiator assembly 100 further includes a circuit board 124 positioned immediately adjacent to the bridge substrate 110. As shown in FIG. 2, the circuit board 124 includes a surface area closely matching the surface area of the bridge substrate 110. The assembly 100 further includes one or more conductive plates 126 (e.g., solder plates in an example) positioned between the bridge substrate 110 and the circuit board 124. The conductive plates 126 provide an electrical intermediate between the initiator leads 128 and the first and second bridge contacts 112, 114 shown in FIG. 2. When solder from the conductive plates 126 reflows and fills the plated through holes 122, the surface area of a continuous planar mounting surface 119 is increased for enhanced support of the charge mounting surface 125 of the explosive charge 104. The initiator assembly 100 further includes, in the example shown, a header 130 adjacent to the circuit board 124. As shown in FIG. 2, the header 130 includes a plurality of lead lumens 134 sized and shaped to receive and thereby pass initiator leads 128 therethrough. The lead lumens 134 in another example are sized and shaped to receive insulators 136, such as glass insulators interposed between the initiator leads 128 and the header 130. The insulators 136 snugly position the initiator leads 128 within the header 130, insulate the initiator leads 128 from each other as well as the header 130, and in at least one example hermetically seal the initiator leads 128 to the header 130.

Assembly of the bridge substrate 110 and circuit board 124, in one example, is accomplished with an adhesive interposed between portions of the bridge substrate 110 and the circuit board 124. In another example, the adhesive extends around the circuit board 124 and bridge substrate 110 to combine the bridge substrate and circuit board 124 into a single unitary element. Alternatively, the adhesive used to couple the circuit board 124 with the bridge substrate 110 is also used to couple the header 130 with the assembly of the bridge substrate 110 and the circuit board 124. In one example, the adhesive includes a non-conductive insulative adhesive that substantially prevents arcing from the bridge substrate 110 to the header 130. In another example, the bridge substrate 110 includes plated through holes 122 providing a conductive via from the first and second bridge contacts 112, 114 to the underlying circuit board 124 and initiator leads 128. In one example, the plated through holes 122 are filled to increase the area of a continuous planar mounting surface 119 and provide enhanced current conduction from the initiator leads 128 to the first and second bridge contacts 112, 114. Optionally, the adhesive previously described is also used to fix one or more of the bridge substrate 110, the circuit board 124 or the header 130 within the initiator cavity 103. Stated another way, the adhesive fixes one or more of the bridge substrate, the circuit board and the header to the interior wall of the initiator cavity 103.

Referring again to FIG. 2, the bridge substrate 110 includes a substrate base 111, first and second bridge contacts 112, 114, bridge 120, plated through holes 122, and first and second backside contacts 142,143. The first and second bridge contacts 112, 114 and bridge 120 are electrically connected and overlay the substrate base 111. The first backside contact 142, in one example, matches the shape of the first bridge contact 112 and is located under the first bridge contact 112 on the backside of the substrate base 111. The second backside contact 143, in another example, matches the shape of the second bridge contact 114 and is located under the second bridge contact 114 on the backside of the substrate base 111. The first bridge contact 112 is electrically connected to the first backside contact 142 with the plated through holes 122. The second bridge contact 114 is electrically connected to the second backside contact 143 with the plated through holes 122. As shown in FIG. 2, each of the first and second bridge contacts 112, 114 in an example are formed in a substantially ovular shape (e.g., a kidney shape) extending over a large portion of the surface area of the substrate base 111 of the bridge substrate 110. The first and second bridge contacts 112, 114 include contact surfaces that are substantially planar and flush to a uniform first planar surface of the substrate base 111. An ionizing bridge 120 extends between the first and second bridge contacts 112, 114. The uniform first planar surface 116 is the side of the substrate base 111 that supports the charge mounting surface 125 of the explosive charge 104. The uniform first planar surface 116 has a substantially large flat surface area relative to discontinuous substrates (and in at least one example provides a structurally robust surface) to ensure consistent and continuous support of a charge mounting surface 125 of the explosive charge 104. In one example, the barrel 106 and flyer plate 108 are interposed between the explosive charge and the bridge substrate, the planar surfaces of each of the barrel 106 and flyer plate 108 ensure surface to surface coupling between the explosive charge and the bridge substrate 110). The first and second bridge contacts 112, 114 and bridge 120 are formed on the uniform first planar surface 116. In one example, the first and second bridge contacts 112, 114 and bridge 120 provide a negligible elevation to the uniform first planar surface 116, for instance, 0.0001 inches relative to the surface 116. The contact surface 118 of the first and second bridge contacts 112, 114 along with the uniform first planar surface 116 thereby provide a continuous planar mounting surface 119 having a substantially flat and planar character to ensure surface to surface coupling with the explosive charge 104.

As shown in FIG. 2, the continuous planar mounting surface 119 formed by the first and second bridge contacts 112, 114 and the uniform first planar surface 116 has an area substantially similar to the area of the charge mounting surface 125 of the explosive charge 104. The matching areas of the explosive charge 104 and the bridge substrate 110 as well as the planar nature of each of the corresponding mounting surfaces 119, 125 ensures the explosive charge 104 and the bridge substrate 110 are coupled together in a surface to surface manner without localized points of contact therebetween. Stated another way, by ensuring consistent and uniform surface-to-surface contact across the areas of the explosive charge 104 and the bridge substrate 110 support is provided by the bridge substrate 110 to the entirety of the explosive charge 104 thereby minimizing stress risers incident on the explosive charge 104 during impact and penetration of an explosive delivery device with a target. During impact and penetration the initiator assembly 100 is exposed to rapid deceleration, acceleration, rebounding, movement of component pieces and the like. The continuous planar mounting surface 119 of the bridge substrate 110 acts as a support to the explosive charge and minimizes fracture of the explosive in this dynamic environment. In another example, with relatively thick first and second bridge contacts 112,114 the continuous planar mounting surface 119 includes the contacts 112, 114 spread across the bridge substrate 110. Stated another way, the continuous planar mounting surface 119 is without the bare areas (e.g., unplated) of the uniform first planar surface 116 and relies on the spread configuration of the first and second bridge contacts 112, 114 to provide support for the overlying components. Optionally, the plated through holes 122 are filled to provide further surface area for the continuous planar mounting surface 119 including the bridge contacts 112, 114.

As shown in FIG. 2, where the first and second bridge contacts 112, 114 include plated through holes 122, the through holes provide an intermediate conductor from the uniform first planar surface 116 to an opposed second surface 107 of the substrate base 111 of the bridge substrate 110. The plated through holes 122 further ensure the first and second bridge contacts 112, 114 provide a flat planar shape (e.g., contact surface 118) that cooperates with the uniform first planar surface 116 to form the continuous planar mounting surface 119. The plated through holes 122 are one example of an intermediate conductor used for connection with the circuit board 124 and initiator leads 128.

In another example, the bridge substrate 110 including the substrate base 111 is constructed with a rigid material including but not limited to ceramics, rigid insulators, and the like. The rigid structure of the bridge substrate 110 ensures the bridge substrate 110 provides rigid support to the ionizing bridge 120 during activation of the initiator assembly 100. For instance, when current is delivered through the first and second bridge contacts 112, 114 the ionizing bridge 120 is rapidly ionized and it develops a large pressure within the initiator cavity 103. The pressure developed by the ionizing bridge 120 is delivered violently to the flyer plate 108 and drives the flyer plate through the barrel 106 to strike the explosive charge 104 and initiate detonation of the explosive payload in the delivery device. The bridge substrate acts as a supporting plate to minimize deflection of the substrate 110 and ensure consistent delivery of pressure toward the explosive charge. As described above, the bridge substrate 110 also acts as a supporting plate to the explosive charge during impact and penetration of a target through surface to surface coupling therebetween.

Optionally, the bridge substrate 110 cooperates with the circuit board 124 and the header 130 to provide additional support to the substrate base 111 and thereby further contain and direct the pressure developed by the ionizing bridge 120 toward the explosive charge 104. Stated another way, one or more of the bridge substrate 110, the circuit board 124 and the header 130 provides structural support to the ionizing bridge 120 and substantially ensures pressure developed by the ionizing bridge 120 during activation of the initiator assembly is directed entirely toward the explosive charge 104 to ensure reliable initiation of the explosive charge with negligible deflection of the bridge substrate 110 in a direction opposed to the explosive charge 104.

In the example shown in FIG. 2, the circuit board 124 consists of a board 141, conductor lands 140, and plated through holes 139. The leads 128 are installed into the plated through holes 139. The leads 128 are electrically connected to the plated through holes 139 with solder, conductive epoxy, or other conductive material. Connection of the bridge 120 to the leads 128 is through the bridge conductors 112, 114, the plated through holes 122, the backside contacts 142, 143, the conductive plates 126, and the conductor lands 140 to the leads 128.

In the example shown in FIG. 2 where the initiator assembly 100 includes a header 130 with insulators 136, the insulators 136 include glass. Coupling of the insulators around the initiator leads 128 causes wicking of the glass of the initiator leads 128 toward the circuit board 124. To avoid stress risers at the juncture between the insulators 136 and the circuit board 124 bevels are formed within the circuit board 124 to receive the wicked glass from the insulators 136, in one example. In another example, chamfers are formed within the lead lumens 134 to receive the wicked glass and thereby substantially prevent further wicking of the glass of the initiator leads 128. Surface-to-surface contact between the circuit board 124 and the header 130 is thereby maintained to ensure the initiator assembly 100 including the first substrate 110, the explosive charge 104, the circuit board 124 and the header 130 couple with surface-to-surface contact throughout to substantially prevent stress risers between any of the components.

Referring again to FIG. 2, the initiator assembly in another example includes an isolation sleeve 138 positioned within the initiator cavity 103 and extending around the explosive charge 104. In one example, the isolation sleeve 138 includes at least one polymer metals, such as steel and the like or combinations of polymers and metals. The isolation sleeve 138 extends around the explosive charge 104 and provides lateral support to the explosive charge 104. The surrounding isolation sleeve 138 ensures lateral forces transmitted to the explosive charge 104, for instance, during a non-perpendicular strike of the explosive delivery device against a target, do not result in lateral deformation and corresponding fracture of the explosive charge 104.

In some conventional initiator assemblies, the explosive charge may be fractured within an initiator housing. As will be discussed in further detail below, a conventional initiator assembly may include multiple features projecting in an irregular fashion between the explosive and a bridge substrate. These projections and recesses between projections cause the fracture of the explosive charge and failure of many conventional initiator assemblies to initiate. In conventional initiator assemblies, the initiator housing may be sized and shaped to receive the components of the initiator assembly therein. In conventional initiator assemblies, the initiator housing contains an explosive charge and a barrel adjacent to the explosive charge. As previously described above, the barrel includes a barrel lumen sized and shaped to pass at least a portion of a flyer plate through to facilitate striking of the explosive charge. Conventional initiator assemblies include means of connecting leads to the bridge, where such means consist of multiple parts which do not uniformly support the barrel and explosive.

In these conventional initiator assemblies, wires or other lead-to-bridge conductors electrically connect the leads to the bridge, creating a non-uniform surface above the bridge substrate for supporting the barrel and explosive. The glass between the leads and header may also extend beyond the header towards the explosive, creating another non-uniform surface for supporting the barrel and explosive. The leads also extend beyond the header, creating more non-uniform surfaces for supporting the barrel and explosive. Further, the previous bridge substrate overlays a portion of the cross-sectional area of the header and the corresponding cross-sectional area of the explosive charge. Stated another way, the previous bridge substrate underlies only a portion of the explosive charge after assembly within the initiator assembly.

Combination of the leads, wires or lead-to-wire conductors, glass fillets, and the bridge substrate in conventional initiator assemblies provides an undulating uneven surface configured for point engagement with the barrel and coupling with the explosive charge. Engagement of the explosive charge (through the barrel) with the uneven surface of the lead, wire or lead-to-wire conductors, glass fillets (in some designs), and the bridge substrate provides point loading to the explosive charge. During impact of an explosive delivery device with a target the device experiences rapid deceleration with corresponding deceleration or acceleration of a conventional initiator assembly, depending on its orientation, as well as rebounding of the components within the initiator assembly and movement of components relative to each other within the assembly.

Damage through a dynamic environment to a conventional initiator assembly may include fracturing of the explosive charge because of force transmitted to the explosive charge at discreet locations from the leads and the smaller bridge substrate. Because the explosive charge is not consistently and uniformly supported by the bridge substrate the explosive charge may become cracked and will not properly initiate when the explosive delivery device impacts and penetrates the target.

In these conventional initiator assemblies, the bridge substrate may takes up less than 50 percent of the total area of the corresponding surface of the explosive charge. Stated another way, the bridge substrate would only support a portion of the area of the explosive charge leaving the remainder of the explosive charge free of support or supported by the uneven contact surfaces of the leads engaged with the barrel interposed therebetween. Minimal support is thereby provided to the explosive charge allowing force concentrations at portions of the explosive charge overlying each of the leads and unsupported portions of the explosive charge overlying areas of the initiator assembly not otherwise covered by the area of the bridge substrate.

Figure 3:
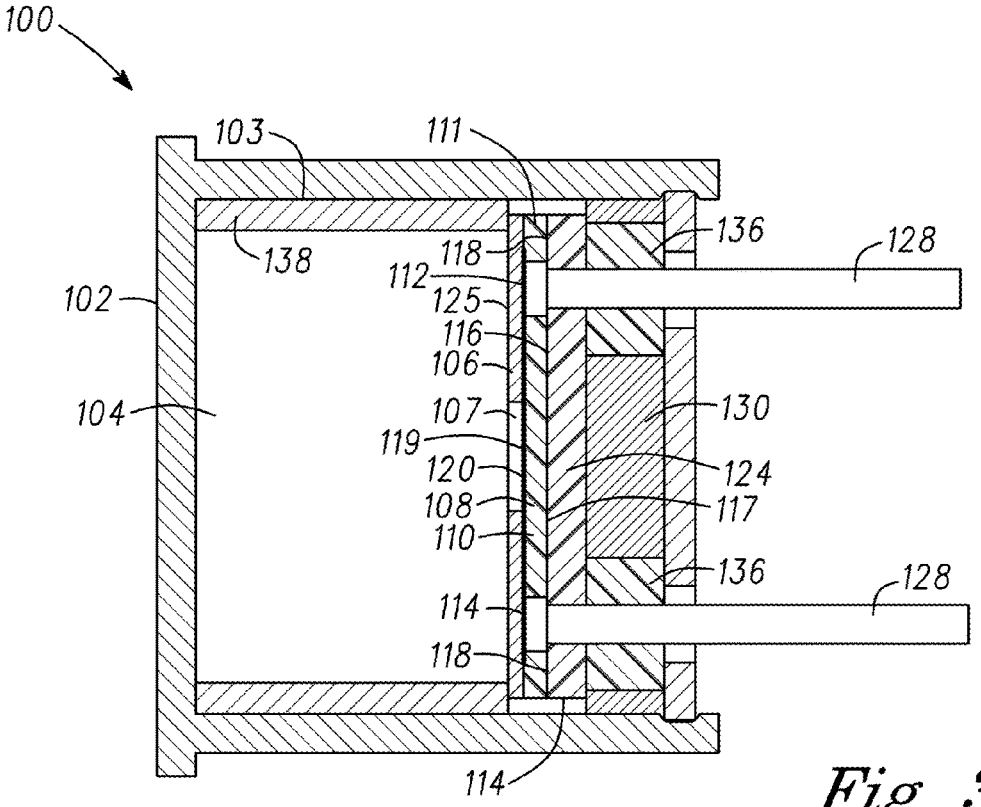
FIG. 3 is a cross sectional view of the initiator assembly shown in FIG. 1 in accordance with some embodiments.

FIG. 3 shows the initiator assembly 100 in a cross-sectional assembled view. As shown, the components of the initiator assembly 100 are housed within the initiator housing 102. For instance, the explosive charge 104 is positioned within the initiator cavity 103 with an isolation sleeve 138 extending around the explosive charge 104. As previously described herein, the isolation sleeve 138 supports the explosive charge 104 against lateral stresses caused by non-perpendicular impacts of an explosive delivery device with a target. Referring again to FIG. 3, the bridge substrate 110 is installed within the initiator cavity 103 adjacent to the circuit board 124 and the header 130. As shown, the initiator leads 128 extend through the header 130 where they are insulated by insulators 136 extending around the initiator leads 128. The initiator leads 128 further extend through the circuit board 124 and are electrically coupled with the first and second bridge contacts 112, 114 on the bridge substrate 110 (e.g., with solder pads 126, solder plugs and the like). As previously described, the bridge substrate 110 further includes an ionizing bridge 120 electrically coupled between the first and second bridge contacts 112, 114. Application of an electrical current through the first and second bridge contacts 112, 114 ionizes the ionizing bridge 120 creating a pressure within the initiator assembly 100 and forcing the flyer plate 108 through the barrel 106 to strike the explosive charge 104 and thereby initiate detonation of the explosive payload.

As shown in FIG. 3, the bridge substrate 110 and filled plated through holes provide a uniform first planar surface 116 and corresponding contact surfaces 118 on each of the first and second bridge contracts 112, 114. The plated through holes can be filled with solder or other material. As previously described herein, the contact surfaces 118 and the uniform first planar surface 116 of the substrate base 111 combine to form a continuous planar mounting surface 119. As shown in FIG. 3, the continuous planar mounting surface 119 extends across the initiator cavity 103 and has a coextensive surface area relative to the explosive charge 104. The continuous planar mounting surface 119 provides a flat and uniform surface for coupling along the majority of the charge mounting surface 125 of the explosive charge 104. The explosive charge 104 is thereby supported along most of its entire surface by the continuous planar mounting surface 119 of the bridge substrate 110. The uniform surface of the continuous planar mounting surface 119 is thereby continuously coupled in surface-to-surface contact across the charge mounting surface 125 of the explosive charge 104. During rapid deceleration, acceleration, rebounding or movement of components of the initiator assembly 100 relative to other components in the assembly a surface-to-surface contact between the continuous planar mounting surface 119 and the charge mounting surface 125 of the respective bridge substrate 110 and explosive charge 104 ensures stresses are not localized at any point along the explosive charge 104. Stated another way, the bridge substrate 110 including the continuous planar mounting surface 119 is coupled along the explosive charge 104 and supports the explosive charge 104 throughout dynamic loading of the explosive charge 104. The continuous surface to surface coupling between the bridge substrate and the explosive charge 104 thereby maintains the explosive charge 104 in a unitary undamaged state at the time of initiation despite violent contact between the explosive delivery device and a target. Further, the bridge substrate 110 is constructed with structurally robust materials (e.g., ceramics) and acts as a support plate to support the explosive charge while minimizing deflection of the bridge substrate.

In contrast, the upwardly projecting leads elevated relative to the bridge substrate and the minimal surface area of the bridge substrate of many conventional initiator assemblies ensure the explosive charge experiences dynamic loading at localized positions around the explosive charge. Transmission of dynamic forces between the bridge substrate and the leads to the explosive charge (e.g., with the barrel therebetween) in these conventional initiator assemblies fractures the explosive charge and frustrates initiation of the explosive charge or causes the initiator assembly to fail entirely. The initiator assembly 100, as shown in FIG. 3, addresses this non-planar non-uniform contact between an explosive charge and a bridge substrate with the use of planar first and second bridge contacts 112, 114 substantially flush with the remainder of the uniform first planar surface 116 to form the continuous planar mounting surface 119 for surface-to-surface contact across the explosive charge 104. The bridge substrate 110 thereby supports the explosive charge 104 across substantially all of the charge mounting surface 125 thereby substantially preventing fracture of the explosive charge 104.

In addition to the uniform planar characteristics of the bridge substrate 110 the bridge substrate is constructed with structurally robust materials including one or more of ceramics, hard insulators, and the like. The materials of the bridge substrate 110 further support the explosive charge 104 and cooperate with the continuous planar mounting surface 119 to substantially ensure the explosive charge 104 is supported throughout dynamic changes to the initiator assembly 100 during impact and penetration of the explosive delivery device with a target. Stated another way, the bridge substrate 110 acts as a support plate to maintain a rigid support structure for the explosive charge and prevent fracture. Further, the example shows the circuit board 124 and the header 130 further cooperating with the bridge substrate 110 to provide additional support to the substrate as well as the explosive charge 104. Engagement between the components of the initiator assembly 100 including the header 130, the circuit board 124, the bridge substrate 110 and the explosive charge 104 ensures the explosive charge is stacked when held in the initiator assembly 100 and supported throughout dynamic changes to the assembly thereby substantially minimizing the risk of fracture of the explosive charge 104 even during impact and penetration of an explosive delivery device through a target. Further, the support provided by one or more of the bridge substrate 110 in combination with the circuit board 124 and the header 130 provides a rigid support to the bridge substrate 110 and the overlying ionizing bridge 120. Activation of the ionizing bridge 120 through the introduction of current across the first and second bridge contacts 112, 114 ensures the ionizing bridge 120 develops a pressure within the initiator cavity 103 that is fully directed toward the explosive 104 and the flyer plate 108. Reliable initiation of the explosive charge 104 is thereby attained. The isolation sleeve 138 further ensures the explosive charge 104 remains in an intact unfractured state during delivery of the explosive delivery device including the initiator assembly 100.

Figure 4:
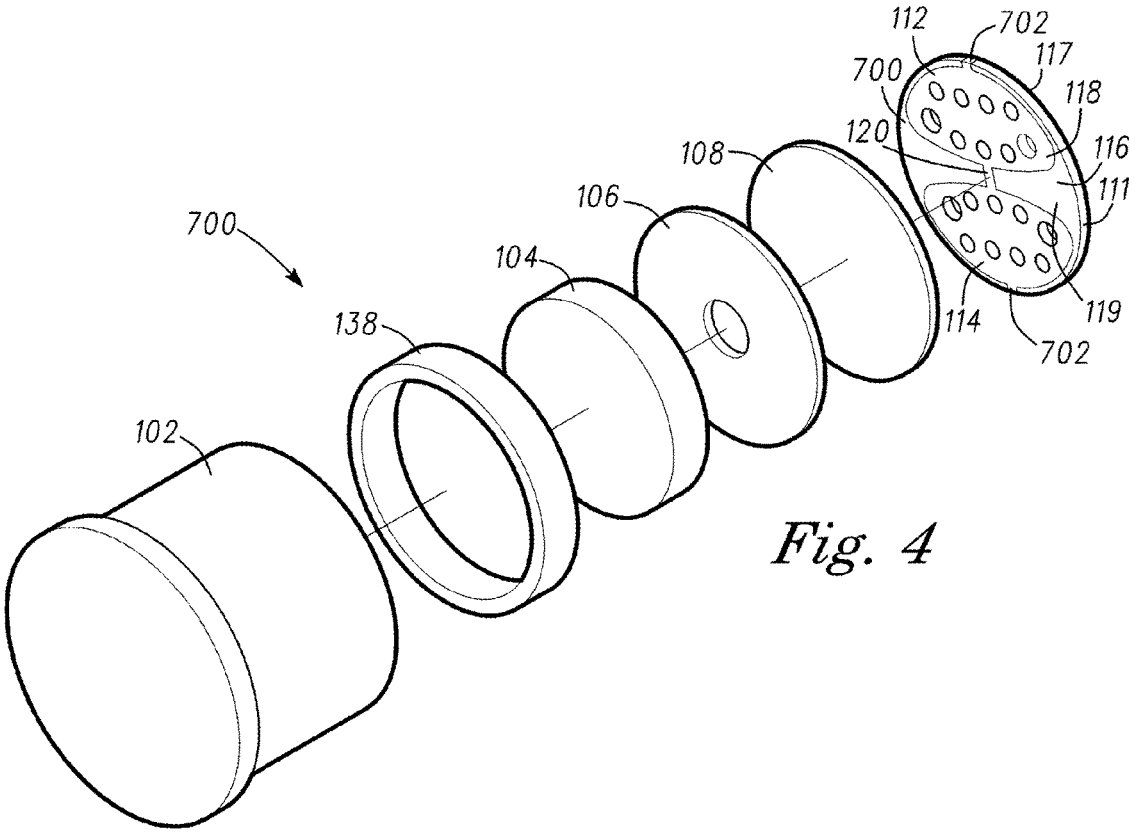
FIG. 4 is a cross sectional view of another example of an initiator assembly without a circuit board or header in accordance with some embodiments.

FIG. 4 shows another example of an initiator assembly 700. As with the previously described initiator assembly 100 the initiator assembly 700 includes an initiator housing 102, an isolation sleeve 138 and an explosive charge 104. The isolation sleeve 138 extends around the explosive charge 104. As shown in FIG. 4, the initiator assembly 700 further includes a barrel 106 and a flyer plate 108 adjacent to one another and positioned within a cavity within the initiator housing 102.

The initiator assembly 700 further includes a bridge substrate 700. The bridge substrate 700 is similar in some regards to the bridge substrate 110 previously described herein. For example, the bridge substrate 700 includes first and second bridge contacts 112, 114 and an ionizing bridge 120. The first and second bridging contacts 112, 114 include corresponding contact surfaces 118 that form a continuous planar mounting surface 119 with the uniform first planar surface 116. As described herein, the continuous planar mounting surface 119 is coupled along a corresponding portion of the explosive charge 104 to ensure a continuous surface-to-surface contact therebetween. As previously stated, when the first and second bridge contacts 112,114 are thick; the area of the continuous planar mounting surface 119 is composed of these contacts 112,114 (i.e. without the unplated area of the uniform first planar surface 116) and with the option for the plated through holes 122 being filled.

The bridge substrate 700 shown in FIG. 4 further includes one or more wrap around conductors 702. In one example the bridge substrate 700 includes a single wrap around conductor 702 coupled with one of the bridge contacts 112, 114. Optionally, the wrap around conductor 702 is electrically engaged with the initiator housing 102 and the initiator housing 102 serves a similar role to one of the initiator leads 128 shown in FIGS. 1 and 2. By using the initiator housing 102 as one of the initiator leads manufacturing and assembly of the initiator assembly 700 is facilitated by removing a component (i.e., one of the initiator leads) from the manufacturing and assembly process. In another example, the initiator assembly 700 includes a plurality of wrap around conductors 702. Each of the wrap around conductors is coupled with one of the bridge contacts 112, 114. In such an example, one of the wrap around conductors 702 is coupled with the initiator housing 102 as previously described and the remaining wrap around conductor 702 wraps around the perimeter of the bridge substrate 700 and engages with a corresponding backside conductor on the second surface 117 of the bridge substrate. Use of the wrap around conductor 702 in this manner eliminates the need for plated through holes for the bridge conductor (i.e. 112 or 114 in FIG. 2) which is connected to the initiator housing 102. An initiator lead 128 couples with the backside conductor and thereby electrically connects with one of the bridge contacts 112, 114 through the wrap around conductor 702.

In the example shown in FIG. 4, the initiator assembly 700 includes a bridge substrate 700 but does not include a circuit board or header as described in previous examples. The bridge substrate 700 provides a robust support (e.g., a support plate) engaged with the initiator housing 102, for instance, by adhesive coupling of the bridge substrate 700 within the initiator housing 102 and supports the explosive charge 104 axially without needing the circuit board or header. In one example, the bridge substrate 100, for instance, the substrate base 111 is thicker and constructed with more robust materials to ensure the bridge substrate 700 properly supports the explosive charge 104 during dynamic loading of the initiator assembly 700 (e.g., during striking and penetration of the target). By removing the circuit board and header assembly manufacturing steps including the assembly of multiple initiator leads through plated through holes in one or more of circuit boards and headers is avoided as the initiator leads are directly coupled with the bridge substrate 700.

As described herein, the bridge substrate 700 generally has a circular configuration matched to the cross-sectional area of the initiator housing 102. The bridge substrate 700 further includes an area fully underlying the explosive charge 104 to ensure continuous surface to surface coupling between the explosive charge 104 and the bridge substrate 700. In other examples, the bridge substrate 700 (or 110) includes other shapes sized and shaped to fit within the initiator housing 102. For instance, the bridge substrate includes, but is not limited to, a star shaped, a triangular shape, a square shape or other configuration. Bridge substrates 700 with non-circular shapes are engaged with correspondingly shaped explosive charges 104. The bridge substrates thereby provide continuous surface-to-surface contact with similarly shaped explosive charges 104. In other examples, bridge substrates 700 with non-circular shapes overlie a portion of an explosive charge 104. For instance, where the bridge substrate 700 has a star shape one or more points of the star shaped support the perimeter portions of the explosive charge 104 thereby minimizing cracking of the explosive charge 104 during dynamic loading of the initiator assembly 700. That is to say, the bridge substrates 700 continue to provide a continuous planar mounting surface 119 sized and shaped for coupling along corresponding surfaces of the explosive charge 104. In still another example, the bridge contacts 112, 114 include other shapes beyond the ovular or kidney shapes provided in FIG. 2 and FIG. 4. For instance, the contact shapes 112, 114 are semi-circular in shape and thereby extend over a majority of the uniform first planar surface 116 of the bridge substrate 700. The bridge contacts 112, 114 with such a shape continue to provide structural support to the explosive charge 104 in combination with the uniform first planar surface 116. In yet another example, the bridge contacts 112, 114 have shapes including but not limited to squares, circles, lines, spiral configurations and the like.

Figure 5:
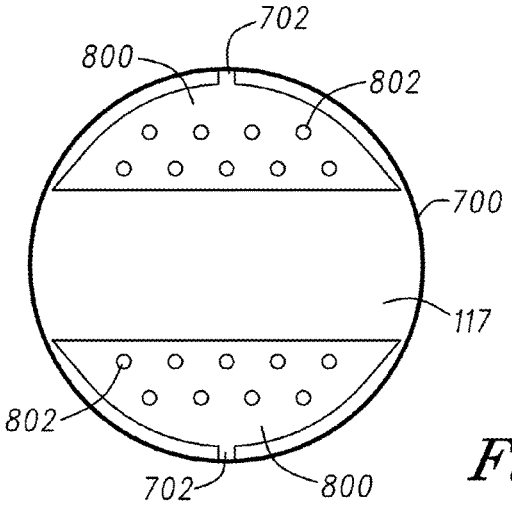
FIG. 5 is a bottom view of the bridge substrate shown in FIG. 4 in accordance with some embodiments.

FIG. 5 shows the bridge substrates 700 from the bottom relative to the view in FIG. 4. The second surface 117 is exposed with backside conductors 800 positioned along the second surface 117. In one example, the backside conductors 800 include plated through holes 802 extending through the bridge substrate 700 to the corresponding bridge contacts 112, 114 on the uniform first planar surface 116 (see FIG. 4). The plated through holes 802 electrically connect the first and second bridge contacts 112 with the backside conductors 800 to facilitate coupling of the contacts 112, 114 with the initiator leads 128 previously described and shown for instance in FIG. 3. In another example, the bridge substrate 700 includes one or more wrap around conductors 702 as previously shown in FIG. 4. In the example shown in FIG. 5 one or more of the wrap around conductors 702 extends around the perimeter of the bridge substrate 700 and is thereby electrically coupled between one backside conductor 800 and one of the bridge contacts 112, 114. Where the initiator assembly 700 includes initiator leads 128 one or more of the initiator leads 128 are coupled with the corresponding backside conductor 800 to thereby electrically couple the bridge contact 112 or 114 with the initiator leads 128. Optionally, one of the wrap around conductors 702 is coupled with the initiator housing 102. As described above, where the initiator housing 102 is constructed with an electrically conductive material, such as steel, the initiator housing 102 acts as a conductor and thereby eliminates the need for one of the initiator leads 128 shown in FIG. 1. Use of the wrap around conductors 702 eliminates one or more of the initiator leads 128 and thereby facilitates easier manufacturing and assembly of the initiator assembly 700.

In yet another example, the second surface 117 of the bridge substrate 700 includes one or more pins extending from the second surface 117. Stated another way, instead of providing backside conductors 800 the bridge substrate 700 provides one or more pins extending away from the second surface 117 for coupling with corresponding electronic components, such as a capacitor used for initiating the initiator assembly 700. Alternatively, the backside conductors 800 are used for coupling of the first and second bridge contacts 112, 114 with a circuit board, such as circuit board 124 through solder pads 126 shown in FIG. 2. In other examples, the backside conductors 800 facilitate electrical coupling with electronic components outside the initiator assembly 700 by coupling with flex cables, rigid connections, other circuits and the like. Optionally, the backside conductors are adapted for coupling with bulls eye connector pins, bulls eye connector screws, bulls eye spanner nuts and one or more spring contacts or other similar features. Alternatively, conductive epoxy is applied along the backside conductors 800 for coupling with the circuit board or other leads, such as the initiator leads 128 described herein.

The initiator assemblies 100, 700 described herein are constructed with a plurality of components as described above. In one example, the bridge substrate is formed with a plurality of similar substrates along a frame (e.g., a sheet) where the bridge substrates 100, 700 are connected with the frame by tabs. The individual bridge substrates 100, 700 are thereafter separated from the sheets for use in separate initiator assemblies 100, 700. As shown in FIG. 2 and FIG. 4, the initiator assemblies 700 are formed by sequential loading of the various components within the initiator cavity of the initiator housing 102. After assembly of the components within the initiator housing 102 the initiator housing is closed, for instance, with an end cap and thereafter compressed to tightly engage each of the components and minimize movement of the components relative to each other when exposed to a dynamic environment, for instance, striking of a target and penetration through into the target. Alternatively, as previously described above, assembly of the initiator assemblies 100, 700 includes adhering one or more of the components, for instance, the bridge substrates, circuit boards and headers together prior to assembly within the initiator housing 102. Optionally, one or more of these components as well as the isolation sleeve 138, the explosive charge 104 and the barrel 106 is adhered within the initiator housing 102, for instance, by adhesives applied along the housing inner wall and the corresponding components of the initiator assembly.

Figure 6A:
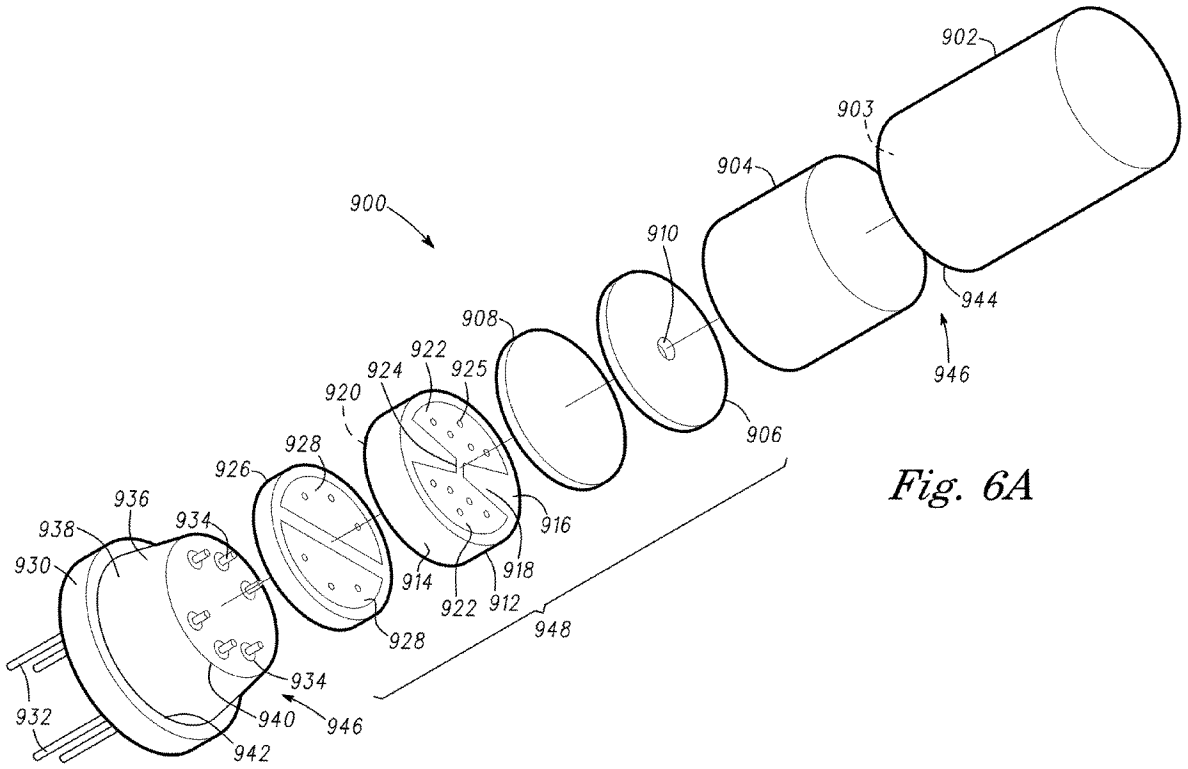
FIG. 6A is an exploded view of another example of an initiator assembly including an initiator clamping assembly.
Figure 6B:
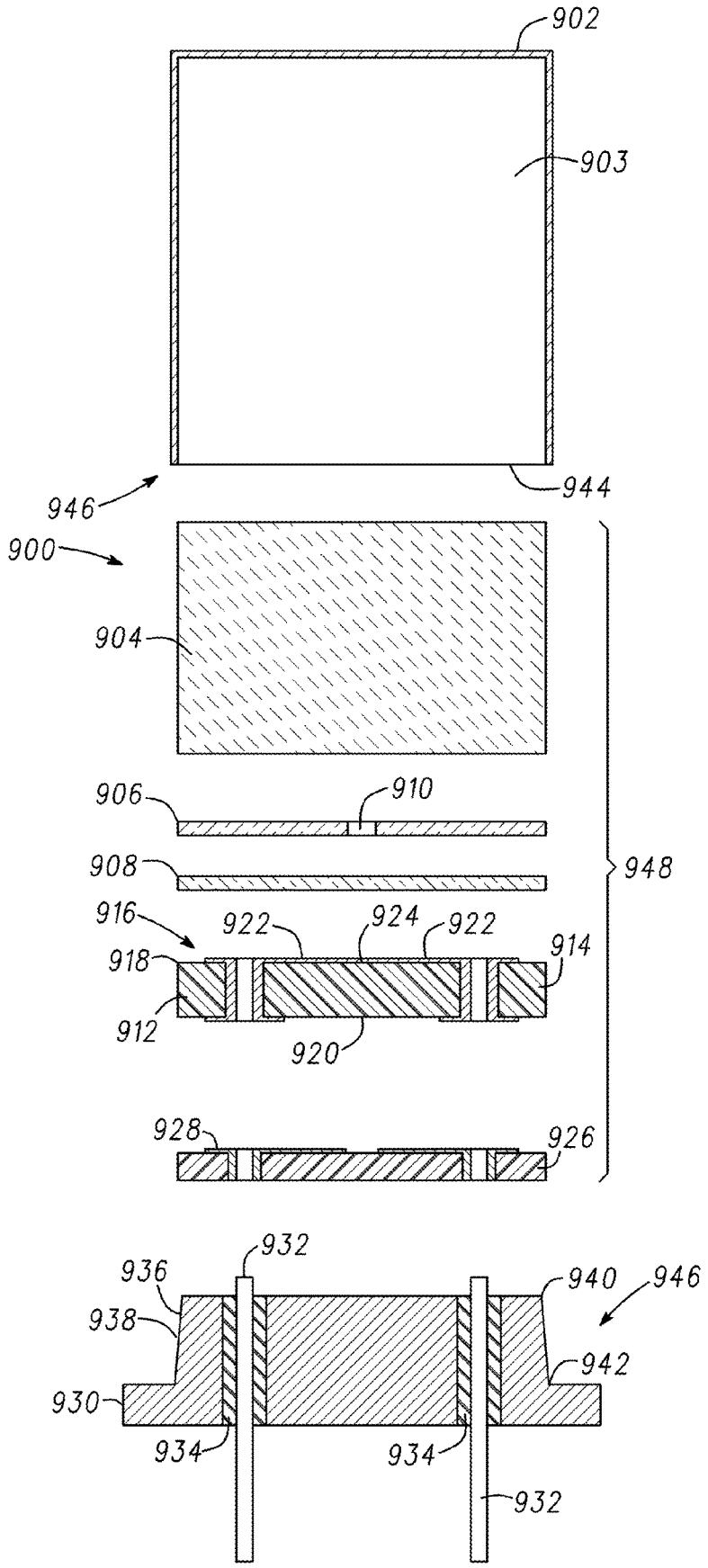
FIG. 6B is an exploded cross sectional view of the initiator assembly of FIG. 6A.

FIGS. 6A and 6B show another example of an initiator assembly 900. As shown the initiator assembly 900 includes a plurality of elements similar in at least some regards to the initiator assemblies 100, 700 previously described and shown herein. For instance the initiator assembly 900 includes an initiator housing 902 including an initiator cavity 903 therein. The initiator cavity 903 is sized and shaped to receive an initiator component stack 948. One example of the initiator component stack is shown in FIGS. 6A and 6B. For instance the initiator component stack includes, but is not limited to, one or more of an explosive charge 904, a barrel 906, a flyer plate 908, a bridge substrate 912 and a circuit board 926. In one example, the components of the initiator component stack 948 are stacked, for instance in surface to surface contact, to provide a chain of static couplings between each of the components to accordingly minimize any stress risers between the bridge substrate 912 and the explosive charge 904. As described herein the static coupling (e.g., a surface-to-surface coupling) between each of these components ensures that the explosive charge 904 is supported during shock loading of the initiator assembly 900, for instance during initial launch while the initiator assembly 900 is within an accelerating munition and during striking and detonation of the munition having the initiator assembly 900 therein.

As further shown in FIGS. 6A and 6B, in one example the barrel 906 includes a barrel lumen 910. The barrel lumen 910 provides a passage for a portion of the flyer plate 908 to pass through prior to striking of the explosive charge 904. As described herein the flyer plate 908 is delivered through the barrel lumen 910 to strike the explosive charge 904 for instance in a planar manner to thereby initiate detonation of the explosive charge 904 as part of an overall detonation for instance of a insensitive munition.

As further shown in FIG. 6A the flyer plate 908 is positioned adjacent to the bridge substrate 912. The bridge substrate 912 as previously described and shown herein includes a first uniform planar surface 918. The bridge contacts 922 and the interposing ionizing bridge 924 are positioned along the first uniform planar surface 918 and form a continuous planar mounting surface 916. The continuous planar mounting surface 916 provides the ionizing bridge 924 and the bridge contacts 922 in a substantially flush manner with the first uniform planar surface 918. Accordingly, the continuous planar mounting surface 916 engages in surface-to-surface with the flyer plate 908. The barrel 906 and explosive charge 904 are similarly provided in surface-to-surface contact to accordingly prevent stress risers at the explosive charge 904. Because of the chain of surface-to-surface contact the explosive charge 904 is maintained in a unitary configuration, for instance any cracking, fracture, powdering or the like of the explosive charge 904 at launch of a munition, striking of the munition with a target or detonation of the munition.

As further shown in FIGS. 6A and 6B, in one example the bridge substrate 912 includes the bridge contacts 922 (e.g., first and second bridge contacts). In one example through holes 925 are provided from the bridge contacts 922 through the substrate base 914 to corresponding contacts on the opposed side such as a second uniform planar surface 920 provided at the opposed side of the bridge substrate 912. The through holes 925 (e.g., plated through holes) provide an electrical interface with the circuit board 926. The circuit board 926 includes as shown one or more conductive plates 928 (e.g., solder plates in an example). Each of the conductive plates accordingly includes pass-throughs (e.g., conductive pass-throughs) that facilitate the coupling of initiator leads 932 of the plunger head 930.

As shown in the example of FIG. 6A the plunger head 930 includes two or more initiator leads 932 associated with each of the sides of the bridge contacts 922. That is to say, as shown each of the initiator leads 932 extends to a corresponding one of the conductive plates 928 and accordingly provides an electrical contact with one of the bridge contacts 922 (coupled with the conductive plate electrically). As shown in the example of FIG. 6A there are two initiator leads 932 associated with each of the sides of the bridge contacts 922. The initiator leads 932 are in one example surrounded by insulators 934 extending through the plunger head 930. In one example the insulators 934 include but are not limited to glass fittings provided within the plunger head 930 to accordingly insulate and allow for wicking of the glass into the plunger head 930 (as described herein).

Referring now to the plunger head 930, as shown the plunger head 930 includes an anchor cylinder face 936 extending between first and second face ends 940, 942. In the one example the second face end 942 includes a flange structure extending away from the anchoring cylinder face 936. As further shown in FIG. 6A and also shown in FIG. 6B the anchoring cylinder face 936 includes a face perimeter 938 extending for instance in an annular manner around the anchoring cylinder face 936. The face perimeter 938 couples with the housing orifice edge 944 of the initiator housing 902 to provide a clamped or anchoring configuration by way of an initiator clamping assembly 946. The initiator component stack 948 is held between the plunger head 930 and the initiator housing 902 by the initiator clamping assembly 946. Accordingly, the initiator component stack 948 is statically held between these components to accordingly provide additional support (to enhance the surface-to-surface contact between the initiator component stack components) and thereby provide a more reliable initiator assembly 900.

Referring now to FIG. 6B, the initiator clamping assembly 946 is described in further detail. In the example shown, the initiator clamping assembly 946 includes the initiator housing 902. As previously described herein the initiator housing 902 includes a housing orifice edge 944 sized and shaped for coupling along the anchoring cylinder face 936 of the plunger head 930. As shown in FIG. 6B the initiator housing 902 is sized and shaped to receive the initiator component stack 948 therein. The initiator component stack is provided in a stacked configuration within the initiator cavity 903. At least a portion of the plunger head 930 is positioned within the initiator housing 902, for instance in a telescopic manner within the initiator housing 902. A portion of the plunger head 930 such as the first face end 940 is engaged against the initiator component stack 948 and clamps the initiator component stack 948 between the initiator housing 902 and the plunger head 930.

Figure 7:
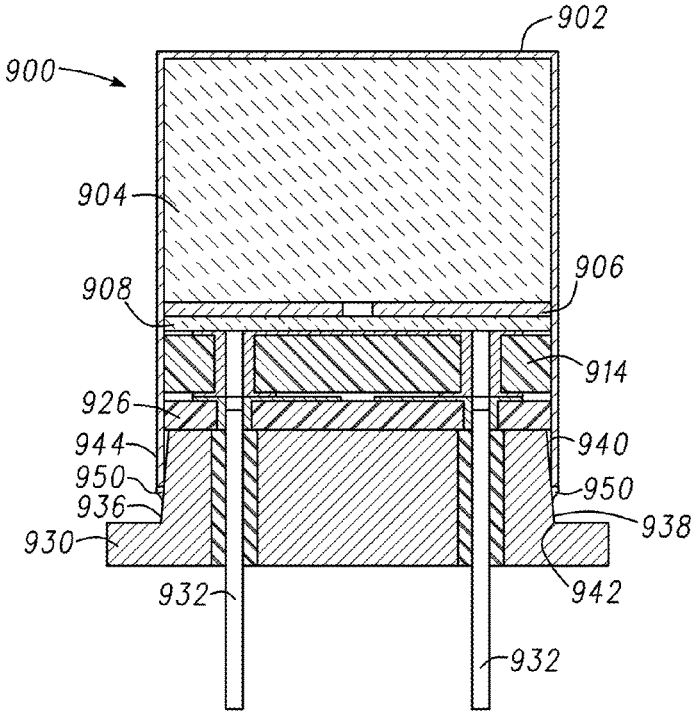
FIG. 7 is a cross sectional view of the assembled initiator assembly of FIG. 6A.

As shown in FIG. 7 and further described herein the housing orifice edge 944 is in one example positioned between the first face end 940 and the second face end 942 in an anchoring configuration. For instance, the housing orifice edge 944 is interference fit with the anchoring cylinder face 936 and thereby holds the plunger head 930 in clamping engagement with the initiator component stack 948. For instance, the housing orifice edge 944 is annularly fit against the face perimeter 938 of the anchoring cylinder face 936 between the first and second face ends 940, 942. In one example the interference fit is used as the method of coupling between the initiator housing 902 and the plunger head 930 to accordingly provide the anchoring configuration of the initiator clamping assembly 946. In another example, after engagement of the plunger head 930 with the initiator component stack 948 the plunger head 930 is fixed to the initiator housing 902, for instance with a weld or intermediate material interfit between the initiator housing 902 (e.g., the housing orifice edge 944) and the anchoring cylinder face 936. Optionally, the interposing material is then braised or welded to each of the plunger head 930 and the initiator housing 902 to finish the coupling of the plunger head 930 to the initiator housing 902 for the anchoring configuration. In still another example, one or more of these methods are combined together to provide a reliable and robust interfit and coupling between the plunger head 930 and the initiator housing 902 to accordingly hold the initiator component stack 948 in the anchoring configuration between the plunger head 930 and the initiator housing 902.

In still another example the anchoring cylinder face 936 has a tapered configuration. For instance, as shown in FIGS. 6A and 6B the anchoring cylinder face 936 tapers from the second face end 942 toward the first face end 940. The tapered configuration of the anchoring cylinder face 936 allows for the ready positioning of the plunger head 930 within the initiator cavity 903. Additionally, the tapered configuration allows for the interference fitting of the anchoring cylinder face 936 with the housing orifice edge 944. As shown in FIGS. 6A and 6B the tapering of the anchoring cylinder face 936 is provided in an exaggerated fashion to illustrate the taper of the anchoring cylinder face. In practice the anchoring cylinder face 936 is tapered in a manner that is difficult for observation by the naked eye (e.g., the face 936 has a draft angle of approximately three to five degrees or other angle compatible with accommodating variations in the thicknesses of the parts in the initiator). In one example the tapering of the anchoring cylinder face 936 facilitates the interference fit of the housing orifice edge 944 along the anchoring cylinder face 936 between the first and second face ends 940, 942.

Referring again to FIG. 7 the initiator assembly 900 previously shown in FIGS. 6A and 6B is provided in the stacked assembled configuration. For instance, the initiator component stack 948 is provided in an engaged or anchoring configuration between the initiator housing 902 and the plunger head 930. As shown in the example of FIG. 7 the first face end 940 is engaged against the initiator component stack 948 (e.g., the circuit board 926) thereby biasing the initiator component stack 948 into clamping engagement between the initiator housing 902 (an inner surface of the initiator housing 902) and the plunger head 930. The initiator component stack 948 is thereby held in the stacked configuration and ensures the maintenance of a reliable surface-to-surface coupling between each of the components. In the example shown in FIG. 7, the initiator component stack includes the barrel 906, the flyer plate 908, the bridge substrate 912 and the circuit board 926. In another example the initiator component stack 948 includes one or more of these components. In still another example the initiator component stack 948 includes additional components provided in the anchoring configuration between the plunger head 930 and the initiator housing 902. As discussed herein, in each of these configurations the components of the initiator component stack 948 are provided in surface-to-surface coupling and are reliably and robustly held in this configuration within the initiator assembly 900 through the clamping engagement of the initiator clamping assembly 946.

As further shown in FIG. 7, the housing orifice edge 944 is anchored to the plunger head 930 along the anchoring cylinder face 936. For instance, the housing orifice edge 944 is anchored to the plunger head 930 between the first and second face ends 940, 942. As will be described herein the interface between the housing orifice edge 944 and the plunger head 930 varies along the anchoring cylinder face 936 according to the fill characteristics of the initiator component stack 948 within the initiator housing 902 (including the initiator cavity 903).

Referring again to FIG. 7, as shown the initiator component stack 948 is provided in a stacked configuration within the initiator cavity 903 of the initiator housing 902. In some examples the initiator component stack 948 has varying dimensions including differences in one or more fill characteristics of the components of the initiator component stack 948. The corresponding changes in dimensions for instance due to tolerance issues or the like of the components of the initiator component stack 948 accordingly change the position of the plunger head 930 relative to the initiator housing 902 when the plunger head 903 is received within the initiator housing. The anchoring cylinder face 936 is provided in the configuration shown, for instance slidable relative to the initiator housing 902, to allow for coupling of the initiator housing 902 in the anchoring configuration at substantially any position between the first and second face ends 940, 942. Accordingly, the initiator assembly 900 described and shown in FIG. 6A through FIG. 7 is able to provide an adjustable coupling between the plunger head 930 and the initiator housing 902 that retains and supports the initiator component stack 948 while at the same time allowing for variable positioning of the plunger head 930 relative to the housing orifice edge 944.

In at least one example, the fill characteristics of the initiator component stack 948 vary according to one or more factors including, but not limited to, the thickness of the explosive charge 904, the plane of the explosive charge for instance the angle of the face of the explosive charge 904 facing the barrel 906, the thickness of the flyer plate 908 and the barrel 906 as well as the thickness and variations in the bridge substrate 912. Each of these components may provide variability to the overall dimensions of the initiator component stack that accordingly positions the plunger head 930 at one or more positions between the first and second face ends 940, 942 relative to the housing orifice edge 944.

For instance, in one example as the plunger head 930 is slidably received within the initiator housing 902 with an initiator component stack 948 varying in length in a positive manner (an increase in length relative to the mean or median) the initiator component stack 948 has a corresponding thickness or height greater than that originally designed for the initiator assembly 900. The plunger head 930 when engaged with the initiator component stack 948 is accordingly biased further towards the first face end 940. The housing orifice edge 944 is accordingly positioned along the anchoring cylinder face 936 (nearer to the first face end 940) according to the height of the initiator component stack 948. The tolerance provided between the first and second face ends 940, 942 allows for coupling of the housing orifice edge at substantially any position between the first and second face ends 940, 942 along the anchoring cylinder face 936. For instance, as shown in FIG. 7 a weld 950 is provided between the housing orifice edge 944 and the anchoring cylinder face 936 according to the clamping position of the plunger head 930 and the corresponding anchoring position of the housing orifice edge 944 along the anchoring cylinder face 936. In another example, the housing orifice edge 944 is crimped along the anchoring cylinder face 936. In still another example the anchoring cylinder face 936 and the housing orifice edge 944 (and the initiator housing 902) engage in a friction fit at any location along the anchoring cylinder face 936 according to the taper of the face (or taper of the initiator housing 902 in another option). In still another example, a two or more of the mechanisms for coupling provided herein are combined to further enhance the strength of the coupling and its reliability.

In another example where the initiator component stack 948 has a smaller dimension for instance provides a lower height or a downward plane relative to the designed dimensions of the initiator component stack 948 (e.g., a mean or median height) the slidably received plunger head 930 is further received within the initiator cavity 902. At the clamping position with the first face end 940 engaged with the initiator component stack 948 (for instance at the circuit board 926) the plunger head 930 is more deeply received within the initiator housing 902. Accordingly, the housing orifice edge 944 is positioned closer to the second face end 942 relative to the previous example described above. Because of the variable positioning provided by the anchoring cylinder face 936 the housing orifice edge 944 is again fit with the plunger head 930 for instance with a weld 950 (crimp, friction fit or the like) along the anchoring cylinder face 936 to accordingly fix the plunger head 930 to the initiator housing 902 and hold the initiator component stack 948 in the anchoring configuration.

As further shown in FIG. 7, and previously described herein in one example the anchoring cylinder face 936 has a tapering configuration. The tapering configuration of the anchoring cylinder face 936 allows for interference fitting of the housing orifice edge 944 for instance in substantially any position between the first and second face ends 940, 942. Accordingly, with changes of the fill characteristics of the initiator component stack 948 the plunger head 930 is engaged with the initiator component stack 948 by providing an interference fit between the housing orifice edge 944 and the plunger head 930. Stated another way, the plunger head 930 provides the clamping engagement between the initiator housing 902 and the plunger head 930 through an interference fit between the housing orifice edge 944 and the anchoring cylinder face 936. The initiator housing 902 and the plunger head 930 engage in Interference fitting for substantially any initiator component stack 948 having a variety of fill characteristics within the initiator cavity 903. Accordingly, the plunger head 930 is correspondingly moved in an axial fashion into and out of the initiator housing 902 according to the fill characteristics of the initiator component stack 948.

The interference fit provides for a temporary or permanent coupling of the plunger head 930 in the anchoring configuration so that the initiator component stack 948 is clamped between the initiator housing 902 and the plunger head 930. If desired a supplemental coupling mechanism is provided between the initiator housing 902 and the plunger head 930 including, but not limited to, the weld 950 shown in FIG. 7, interposing material between the housing orifice edge 944 and the plunger head 930 (e.g., a shim) that is subsequently held in place with the interference fit or a supplemental mechanism such as the weld, adhesives, crimping or the like.

Figure 8:
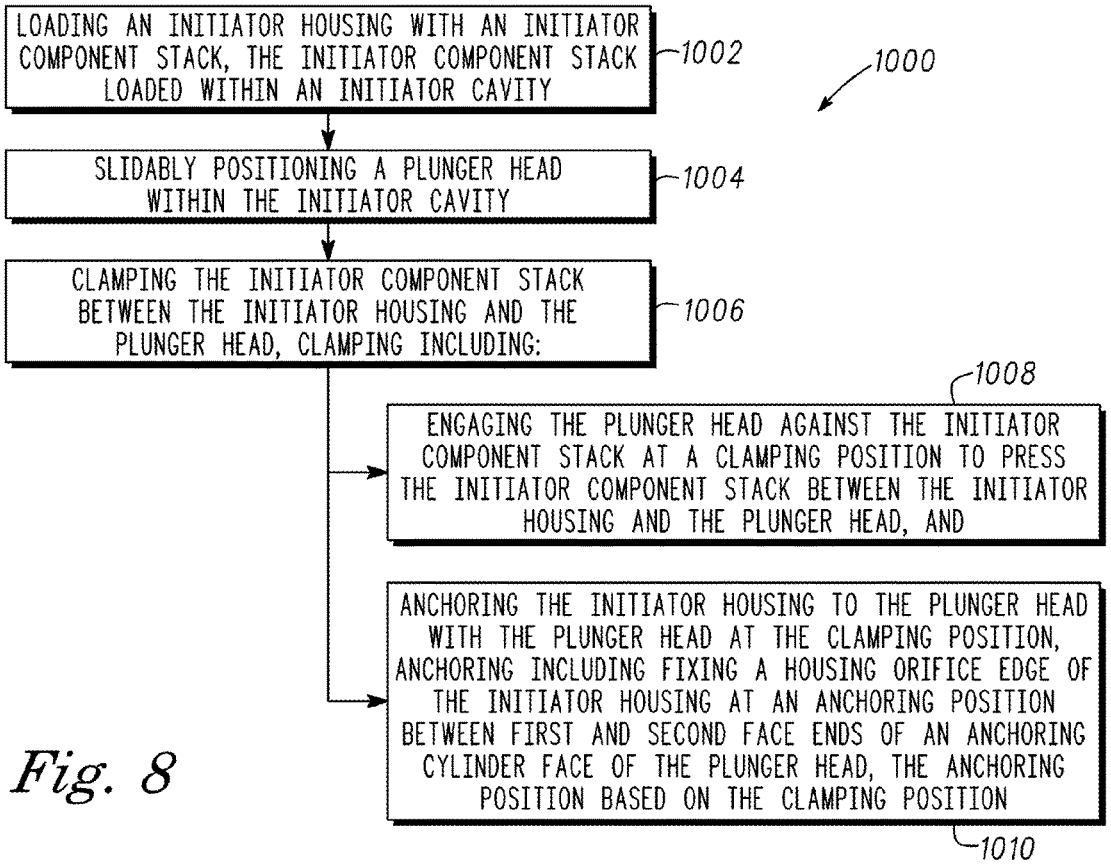
FIG. 8 is a block diagram showing one example of a method for assembling an initiator.

FIG. 8 shows one example of a method 1000 for assembling an initiator. In one example, the initiator includes an initiator assembly such as the initiator assembly 900 shown in FIGS. 6A, 6B and 7. In describing the method 1000 reference is made to one or more components, features, functions and the like described herein. Where convenient, reference is made to the components and features with reference numerals. Reference numerals provided are exemplary and are not exclusive. For instance, the components, features, functions and the like described in the method 1000 include, but are not limited to, the corresponding numbered elements, other corresponding features described herein (both numbered and unnumbered) as well as their equivalents.

At 1002, the method 1000 includes loading an initiator housing 902 with an initiator component stack (e.g., stack 948), the initiator component stack loaded within an initiator cavity 903. In one example, the initiator component stack 948 includes, but is not limited to, the circuit board 926, bridge substrate 912, flyer plate 908, barrel 906 or the like. In another example, the initiator component stack 948 includes one or more components, for instance one or more of the components recited herein, other components of an initiator or the like.

At 1004, a plunger head 930 is slidably positioned within the initiator cavity 903. For instance, the plunger head 930 telescopes relative to the initiator housing 902 (e.g., the housing orifice edge 944) for adjustable positioning of the plunger head 930 while clamping the initiator component stack 948 in the anchoring position (irrespective of the fill characteristics of the component stack 948). In one example, slidably positioning the plunger head includes positioning the housing orifice edge 944 around the anchoring cylinder face and sliding the housing orifice edge 944 between first and second face ends 940, 942. The housing orifice edge 944 is anchored along the anchoring cylinder face 936 (and between the first and second face ends 940, 942) according to the fill characteristics and the fit of the anchoring cylinder face relative to the housing orifice edge (e.g., an interference fit as a function of diameters, taper of the anchoring cylinder face or the housing or the like).

At 1006, the method 1000 includes clamping the initiator component stack 948 between the initiator housing 902 and the plunger head 930. As shown herein, for instance in FIG. 7, the initiator component stack 948 is clamped between the plunger head 930 (e.g., the first face end 940) and the initiator housing 902 (an interior face of the housing at the end of the initiator cavity 903). The plunger head 930 is engaged against the initiator component stack 948 and snugly holds the stack 948 within the initiator housing 902.

In one example, clamping includes at 1008 engaging the plunger head 930 against the initiator component stack 948 at a clamping position to press the initiator component stack 948 between the initiator housing 902 and the plunger head 930. The clamping position corresponds to the location of the first face end 940 relative to the initiator housing 902 (e.g., its inner wall) at engagement with the stack 948 and when the stack 948 is firmly clamped between the housing 902 and the plunger head 930. The clamping position varies according to the fill characteristics of the initiator component stack 948. Stated another way, the plunger head 930 (e.g., the anchoring cylinder face 936) is engaged against the initiator component stack 948 at a variable clamping position based on one or more fill characteristics as described herein.

In another example, clamping includes at 1010 anchoring the initiator housing 902 to the plunger head 930 with the plunger head 930 at the clamping position. Anchoring includes fixing the housing orifice edge 944 of the initiator housing 902 at an anchoring position between first and second face ends 940, 942 of the anchoring cylinder face 936 of the plunger head. Optionally, the anchoring position of the housing orifice edge 944 anchored along the anchoring cylinder face 936 is based on the clamping position. For instance, at the clamping position where the plunger head 930 firmly clamps the initiator component stack 948 the anchoring position is that location between the first and second face ends 940, 942 adjacent to the housing orifice edge 944. Accordingly, with anchoring of the housing orifice edge 944 to the anchoring cylinder face 936 at the anchoring location the clamping of the initiator component stack 948 is maintained.

Several options for the method 1000 follow. In one example, loading the initiator housing 902 includes stacking each of a plurality of initiator components in surface-to-surface contact with adjacent initiator components of the plurality of initiator components. For instance, as described herein the initiator components are stacked in surface-to-surface contact to mitigate or eliminate stress risers and thereby prevent damage to the initiator components during shock loading (e.g., launch, impact, storage or the like).

In another example, anchoring the initiator housing 902 to the plunger head 930 includes interference fitting the plunger head 930 within the housing orifice edge 944 according to a taper of the plunger head between the first and second face ends 940, 944. As described herein, the anchoring cylinder face 936 is optionally tapered between the first and second face ends. The taper facilitates alignment of the plunger head 930 with the initiator cavity 903 and also facilitates the retention of the plunger head 930 in place (e.g., the anchoring position) through an interference fit. In one example, the interference fit serves as the anchor to maintain the plunger head 930 in the anchoring configuration. In another example, a supplemental feature is used with the interference fit, including, but not limited to, a weld, crimp, adhesive, ship or the like. In still another example, anchoring the initiator housing 902 to the plunger head 930 includes welding the housing orifice edge 944 to the anchoring cylinder face 936 of the plunger head 930 at the anchoring position, for instance without an interference fit.

CONCLUSION

The initiator assemblies described herein provide reliable axial and lateral support for the explosive charge and thereby prevent fracture of the explosive charge during dynamic loading through impact and penetration of an explosive delivery device with a target. A robust bridge substrate described herein provides structural support through surface-to-surface contact coupling between the bridge substrate and the explosive charge. Mechanical loads are spread over a large area of the bridge substrate mated to a corresponding area of the explosive charge. Because the bridge substrate presents a continuous planar mounting surface at a minimum comprising the surface of the bridge contacts, the explosive charge is reliably supported across the majority of its surface area to substantially prevent point loads at any location on the explosive charge. Rapid deceleration or acceleration of the initiator assembly with corresponding dynamic loading between the explosive charge and the bridge substrate is transmitted across the surface-to-surface contact between the two components and thereby substantially avoids any localized stresses at any point on the explosive charge.

Similarly, the isolation sleeve coupled around the explosive charge substantially prevents lateral stresses from fracturing the explosive charge where the explosive delivery device impacts and penetrates a target at a non-perpendicular angle. The explosive charge is thereby supported in axially and lateral directions throughout dynamic loading (e.g., for instance impact, penetration and the like) and is maintained in unitary unfractured state. Reliable and consistent initiation of the initiator assembly is thereby maximized while partial or entire failures of the initiator assembly to initiate are substantially minimized.

In the foregoing description, the subject matter has been described with reference to specific exemplary examples. However, it will be appreciated that various modifications and changes may be made without departing from the scope of the present subject matter as set forth herein. The description and figures are to be regarded in an illustrative manner, rather than a restrictive one and all such modifications are intended to be included within the scope of the present subject matter. Accordingly, the scope of the subject matter should be determined by the generic examples described herein and their legal equivalents rather than by merely the specific examples described above. For example, the steps recited in any method or process example may be executed in any order and are not limited to the explicit order presented in the specific examples. Additionally, the components and/or elements recited in any apparatus example may be assembled or otherwise operationally configured in a variety of permutations to produce substantially the same result as the present subject matter and are accordingly not limited to the specific configuration recited in the specific examples.

Benefits, other advantages and solutions to problems have been described above with regard to particular examples; however, any benefit, advantage, solution to problems or any element that may cause any particular benefit, advantage or solution to occur or to become more pronounced are not to be construed as critical, required or essential features or components.

As used herein, the terms "comprises", "comprising", or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present subject matter, in addition to those not specifically recited, may be varied or otherwise particularly adapted to specific environments, manufacturing specifications, design parameters or other operating requirements without departing from the general principles of the same.

The present subject matter has been described above with reference to examples. However, changes and modifications may be made to the examples without departing from the scope of the present subject matter. These and other changes or modifications are intended to be included within the scope of the present subject matter, as expressed in the following claims.

It is to be understood that the above description is intended to be illustrative, and not restrictive. Many other examples will be apparent to those of skill in the art upon reading and understanding the above description. It should be noted that examples discussed in different portions of the description or referred to in different drawings can be combined to form additional examples of the present application. The scope of the subject matter should, therefore, be determined with reference to the appended claims, along with the full scope of equivalents to which such claims are entitled.

EXAMPLES

Example 1 can include subject matter, such as can include an initiator assembly comprising: an initiator housing including an initiator cavity and a housing orifice edge; a bridge substrate positioned within the initiator cavity, the bridge substrate including: a substrate base including a uniform first planar surface, and first and second bridge contacts flush with the uniform first planar surface, the first and second bridge contacts coupled at an ionizing bridge, and wherein the first and second bridge contacts form a continuous planar mounting surface; an explosive charge within the initiator cavity; a flyer plate within the initiator cavity and interposed between the explosive charge and the bridge substrate; and a plunger head telescopically received in the initiator cavity, the plunger head includes an anchoring cylinder face having a face perimeter and extending between first and second face ends, the housing orifice edge anchored to the anchoring cylinder face at a position between the first and second face ends and extending around the face perimeter.

Example 2 can include, or can optionally be combined with the subject matter of Example 1, to optionally include wherein the telescoping plunger head includes sliding and anchoring configurations: in the sliding configuration the anchoring cylinder face is slidable along the housing orifice edge between the first and second face ends, and in the anchoring configuration the plunger head is engaged against the bridge substrate at a clamping position and clamps the bridge substrate, the flyer plate and the explosive charge between the plunger head and the initiator housing, and the housing orifice edge is anchored at an anchoring position between the first and second face ends based on the clamping position.

Example 3 can include, or can optionally be combined with the subject matter of one or any combination of Examples 1 or 2 to optionally include wherein the clamping position and the anchoring position based on the clamping position vary according to one or more fill characteristics within the initiator cavity of at least one of the explosive charge, flyer plate and the bridge substrate.

Example 4 can include, or can optionally be combined with the subject matter of one or any combination of Examples 1-3 to optionally include wherein the one or more fill characteristics includes at least one of an explosive charge thickness, an explosive charge plane angle, a flyer plate thickness, and a bridge substrate thickness.

Example 5 can include, or can optionally be combined with the subject matter of one or any combination of Examples 1-4 to optionally include wherein the anchoring cylinder face tapers from between the first face end and the second face end toward the first face end.

Example 6 can include, or can optionally be combined with the subject matter of Examples 1-5 to optionally include wherein the housing orifice edge anchored to the anchoring cylinder face includes the housing orifice edge interference fit with the anchoring cylinder face according to the taper.

Example 7 can include, or can optionally be combined with the subject matter of Examples 1-6 to optionally include wherein the housing orifice edge anchored to the anchoring cylinder face is welded to the anchoring cylinder face at the position between the first and second end faces.

Example 8 can include, or can optionally be combined with the subject matter of Examples 1-7 to optionally include wherein an anchor filler is interposed between the housing orifice edge and the anchoring cylinder face at the position between the first and second end faces.

Example 9 can include, or can optionally be combined with the subject matter of Examples 1-8 to optionally include wherein a barrel is coupled with the flyer plate, and the flyer plate is coupled along the continuous planar mounting surface and the barrel is coupled along the explosive charge in surface-to-surface contact, respectively.

Example 10 can include, or can optionally be combined with the subject matter of Examples 1-9 to optionally include a static coupling in surface-to-surface contact between the explosive charge and the continuous planar mounting surface of the bridge substrate according to a chain of surface-to-surface contact between the continuous planar mounting surface, the flyer plate, a barrel and the explosive charge.

Example 11 can include, or can optionally be combined with the subject matter of Examples 1-10 to optionally include an initiator assembly comprising: an initiator housing including a housing wall extending to a housing orifice edge with an initiator cavity therein; initiator component stack within the initiator cavity; an initiator clamping assembly including: the housing orifice edge, and a plunger head telescopically received in the initiator cavity, the plunger head includes an anchoring cylinder face extending between first and second face ends; and wherein the initiator clamping assembly includes sliding and anchoring configurations: in the sliding configuration the anchoring cylinder face is slidable along the housing orifice edge between the first and second face ends, and in the anchoring configuration the plunger head is engaged against the initiator component stack at a clamping position that clamps the initiator component stack between the plunger head and the initiator housing, and the housing orifice edge is anchored on the anchoring cylinder face at an anchoring position between the first and second face ends based on the clamping position.

Example 12 can include, or can optionally be combined with the subject matter of Examples 1-11 to optionally include wherein the plunger head includes initiator leads in electrical communication with an ionizing bridge of a bridge substrate within the initiator cavity.

Example 13 can include, or can optionally be combined with the subject matter of Examples 1-12 to optionally include wherein the initiator component stack includes: an explosive charge within the initiator cavity, a flyer plate within the initiator cavity, a barrel within the initiator cavity interposed between the explosive charge and the flyer plate, and a bridge substrate positioned within the initiator cavity, the bridge substrate including an ionizing bridge.

Example 14 can include, or can optionally be combined with the subject matter of Examples 1-13 to optionally include a static coupling in surface-to-surface contact between the explosive charge and a continuous planar mounting surface of the bridge substrate according to a chain of surface-to-surface contact between the continuous planar mounting surface, the flyer plate, a barrel and the explosive charge.

Example 15 can include, or can optionally be combined with the subject matter of Examples 1-14 to optionally include wherein the clamping position and the anchoring position based on the clamping position vary according to one or more fill characteristics of the initiator component stack within the initiator cavity. Example 16 can include, or can optionally be combined with the subject matter of Examples 1-15 to optionally include wherein the one or more fill characteristics includes at least one of an explosive charge thickness, an explosive charge plane angle, a flyer plate thickness, and a bridge substrate thickness.

Example 17 can include, or can optionally be combined with the subject matter of Examples 1-16 to optionally include wherein the plunger head tapers from between the first face end and the second face end toward the first face end, and the housing orifice edge anchored on the anchoring cylinder face includes the housing orifice edge interference fit with the anchoring cylinder face according to the taper.

Example 18 can include, or can optionally be combined with the subject matter of Examples 1-17 to optionally include wherein housing orifice edge anchored on the anchoring cylinder face includes a weld between the first and second end faces.

Example 19 can include, or can optionally be combined with the subject matter of Examples 1-18 to optionally include a method of assembling an initiator comprising: loading an initiator housing with an initiator component stack, the initiator component stack loaded within an initiator cavity; slidably positioning a plunger head within the initiator cavity; and clamping the initiator component stack between the initiator housing and the plunger head, clamping including: engaging the plunger head against the initiator component stack at a clamping position to press the initiator component stack between the initiator housing and the plunger head, and anchoring the initiator housing to the plunger head with the plunger head at the clamping position, anchoring including fixing a housing orifice edge of the initiator housing at an anchoring position between first and second face ends of an anchoring cylinder face of the plunger head, the anchoring position based on the clamping position.

Example 20 can include, or can optionally be combined with the subject matter of Examples 1-19 to optionally include wherein loading the initiator housing includes stacking each of a plurality of initiator components in surface-to-surface contact with adjacent initiator components of the plurality of initiator components.

Example 21 can include, or can optionally be combined with the subject matter of Examples 1-20 to optionally include wherein anchoring the initiator housing to the plunger head includes interference fitting the plunger head within the housing orifice edge according to a taper of the plunger head between the first and second face ends.

Example 22 can include, or can optionally be combined with the subject matter of Examples 1-21 to optionally include wherein anchoring the initiator housing to the plunger head includes welding the housing orifice edge to the anchoring cylinder face of the plunger head at the anchoring position.

Example 23 can include, or can optionally be combined with the subject matter of Examples 1-22 to optionally include wherein the clamping position varies according to one or more fill characteristics of the initiator component stack within the initiator cavity, and engaging the plunger head against the initiator component stack at the clamping position includes engaging the plunger head against the initiator component stack at a variable clamping position based on to the one or more fill characteristics.

Each of these non-limiting examples can stand on its own, or can be combined in any permutation or combination with any one or more of the other examples.

What is claimed is:

1. An initiator assembly comprising:

an initiator housing including an initiator cavity and a housing orifice edge;

a bridge substrate positioned within the initiator cavity, the bridge substrate including:

a substrate base including a uniform first planar surface, and first and second bridge contacts flush with the uniform first planar surface, the first and second bridge contacts coupled at an ionizing bridge, and wherein the first and second bridge contacts form a continuous planar mounting surface;

an explosive charge within the initiator cavity;

a flyer plate within the initiator cavity and interposed between the explosive charge and the bridge substrate; and a plunger head telescopically received in the initiator cavity, the plunger head includes an anchoring cylinder face having a face perimeter, the anchoring cylinder face is continuous and flat from a first face end proximate the bridge substrate to a second face end remote from the bridge substrate, the housing orifice edge anchored to the anchoring cylinder face at an anchoring position between the first and second face ends and spaced from the second face end according to one or more fill characteristics within the initiator cavity of one or more of the explosive charge, the flyer plate and the bridge substrate, the housing orifice edge extending around the face perimeter at the anchoring position.

2. The initiator assembly of claim 1, wherein the telescoping plunger head includes sliding and anchoring configurations:

in the sliding configuration the anchoring cylinder face is slidable along the housing orifice edge between the first and second face ends, and in the anchoring configuration the plunger head is engaged against the bridge substrate at a clamping position and clamps the bridge substrate, the flyer plate and the explosive charge between the plunger head and the initiator housing, and the housing orifice edge is anchored at the anchoring position between the first and second face ends based on the clamping position.

3. The initiator assembly of claim 2, wherein the clamping position and the anchoring position vary according to the one or more fill characteristics within the initiator cavity of at least one of the explosive charge, flyer plate and the bridge substrate.

4. The initiator assembly of claim 3, wherein the one or more fill characteristics includes at least one of an explosive charge thickness, an explosive charge plane angle, a flyer plate thickness, and a bridge substrate thickness.

5. The initiator assembly of claim 1, wherein the anchoring cylinder face tapers from between the first face end and the second face end toward the first face end.

6. The initiator assembly of claim 5, wherein the housing orifice edge anchored to the anchoring cylinder face includes the housing orifice edge interference fit with the anchoring cylinder face according to the taper.

7. The initiator assembly of claim 1, wherein the housing orifice edge anchored to the anchoring cylinder face is welded to the anchoring cylinder face at the position between the first and second end faces.

8. The initiator assembly of claim 1, wherein an anchor filler is interposed between the housing orifice edge and the anchoring cylinder face at the position between the first and second end faces.

9. The initiator assembly of claim 1, wherein a barrel is coupled with the flyer plate, and the flyer plate is coupled along the continuous planar mounting surface and the barrel is coupled along the explosive charge in surface-to-surface contact, respectively.

10. The initiator assembly of claim 1 comprising a static coupling in surface-to-surface contact between the explosive charge and the continuous planar mounting surface of the bridge substrate according to a chain of surface-to-surface contact between the continuous planar mounting surface, the flyer plate; a barrel and the explosive charge.

11. The initiator assembly of claim 1, wherein the housing orifice edge anchor to the anchoring cylinder face at the anchoring position includes the housing orifice edge engaged to the anchoring cylinder face.

12. An initiator assembly comprising:

an initiator housing including a housing wall extending to a housing orifice edge with an initiator cavity therein;

an initiator component stack within the initiator cavity;

an initiator clamping assembly including:

the housing orifice edge, and a plunger head telescopically received in the initiator cavity, the plunger head includes a continuous and flat anchoring cylinder face extending between a first face end proximate the initiator component stack and a second face end remote from the initiator component stack; and wherein the initiator clamping assembly includes sliding and anchoring configurations:

in the sliding configuration the anchoring cylinder face is slidable along the housing orifice edge between the first and second face ends, and in the anchoring configuration the plunger head is engaged against the initiator component stack at a clamping position that clamps the initiator component stack between the plunger head and the initiator housing, and the housing orifice edge is anchored on the anchoring cylinder face at an anchoring position between the first and second face ends and spaced from at least the second face end based on the clamping position and a height of the initiator component stack within the initiator cavity.

13. The initiator assembly of claim 12, wherein the plunger head includes initiator leads in electrical communication with an ionizing bridge of a bridge substrate within the initiator cavity.

14. The initiator assembly of claim 12, wherein the initiator component stack includes:

an explosive charge within the initiator cavity, a flyer plate within the initiator cavity, a barrel within the initiator cavity interposed between the explosive charge and the flyer plate, and a bridge substrate positioned within the initiator cavi the bridge substrate including an ionizing bridge.

15. The initiator assembly of claim 14 comprising a static coupling in surface-to-surface contact between the explosive charge and a continuous planar mounting surface of the bridge substrate according to a chain of surface-to-surface contact between the continuous planar mounting surface, the flyer plate, a barrel and the explosive charge.

16. The initiator assembly of claim 12, wherein the clamping position and the anchoring position based on the clamping position vary according to one or more fill characteristics of the initiator component stack within the initiator cavity.

17. The initiator assembly of claim 16, wherein the one or more fill characteristics includes at least one of an explosive charge thickness, an explosive charge plane angle, a flyer plate thickness, and a bridge substrate thickness.

18. The initiator assembly of claim 12, wherein the plunger head tapers from between the first face end and the second face end toward the first face end, and the housing orifice edge anchored on the anchoring cylinder face includes the housing orifice edge interference fit with the anchoring cylinder face according to the taper.

19. The initiator assembly of claim 12, wherein housing orifice edge anchored on the anchoring cylinder face includes a weld between the first and second end faces.

20. A method of assembling an initiator comprising:

loading an initiator housing with an initiator component stack, the initiator component stack loaded within an initiator cavity;

slidably positioning a plunger head within the initiator cavity; and clamping the initiator component stack between the initiator housing and the plunger head, clamping including:

engaging the plunger head against the initiator component stack at a clamping position to press the initiator component stack between the initiator housing and the plunger head, and anchoring the initiator housing to the plunger head with the plunger head at the clamping position, anchoring including fixing a housing orifice edge of the initiator housing at an anchoring position anywhere between a first face end proximate the initiator component stack and a second face end remote from the initiator component stack of a continuous anchoring cylinder face of the plunger head extending between the first and second face ends, the anchoring position based on the clamping position and spaced from at least the second face end according to a height of initiator component stack in the initiator cavity.

21. The method of claim 10, wherein loading the initiator housing includes stacking each of a plurality of initiator components in surface-to-surface contact with adjacent initiator components of the plurality of initiator components.

22. The method of claim 20, wherein anchoring the initiator housing to the plunger head includes interference fitting the plunger head within the housing orifice edge according to a taper of the plunger head between the first and second face ends.

23. The method of claim 20, wherein anchoring the initiator housing to the plunger head includes welding the housing orifice edge to the anchoring cylinder face of the plunger head at the anchoring position.

24. The method of claim 20, wherein the clamping position varies according to one or more fill characteristics of the initiator component stack within the initiator cavity, and engaging the plunger head against the initiator component stack at the clamping position includes engaging the plunger head against the initiator component stack at a variable clamping position based on to the one or more fill characteristics.

* * * * *